US009417021B2

(12) United States Patent
Pietila

(10) Patent No.: US 9,417,021 B2
(45) Date of Patent: Aug. 16, 2016

(54) FIREARM SUPPRESSOR

(71) Applicant: SAKO OY, Riihimaki (FI)

(72) Inventor: Jarno Pietila, Hameenlinna (FI)

(73) Assignee: SAKO OY, Riihimaki (FI)

( * ) Notice: Subject to any disclaimer, the term of this patent is extended or adjusted under 35 U.S.C. 154(b) by 0 days.

(21) Appl. No.: 14/443,169

(22) PCT Filed: Nov. 15, 2012

(86) PCT No.: PCT/FI2012/051124
§ 371 (c)(1),
(2) Date: May 15, 2015

(87) PCT Pub. No.: WO2014/076356
PCT Pub. Date: May 22, 2014

(65) Prior Publication Data

US 2015/0292829 A1 Oct. 15, 2015

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4, 14.3
See application file for complete search history.

(56) References Cited

U.S. PATENT DOCUMENTS

| | | | | |
|---|---|---|---|---|
| 3,667,570 | A | 6/1972 | Werbell | |
| 7,891,282 | B1 * | 2/2011 | DeGroat | 89/14.4 |
| 8,087,337 | B1 * | 1/2012 | Cary | 89/14.3 |
| 8,967,326 | B2 * | 3/2015 | Schlosser | 181/223 |
| 2012/0145478 | A1 * | 6/2012 | Brittingham | 181/223 |
| 2012/0272818 | A1 * | 11/2012 | Dueck et al. | 89/14.4 |
| 2012/0273297 | A1 * | 11/2012 | Schlosser | 181/213 |
| 2014/0020976 | A1 * | 1/2014 | Shults | 181/223 |
| 2014/0231168 | A1 * | 8/2014 | Dueck et al. | 181/223 |
| 2014/0318887 | A1 * | 10/2014 | Latka | 181/223 |
| 2014/0360807 | A1 * | 12/2014 | McKenzie | 181/223 |
| 2015/0001001 | A1 * | 1/2015 | Wilson | 181/223 |

FOREIGN PATENT DOCUMENTS

| | | | |
|---|---|---|---|
| DE | 28 24 546 | A1 | 12/1979 |
| EP | 0 660 915 | B1 | 5/1997 |
| EP | 2 191 223 | B1 | 11/2011 |
| GB | 2 106 619 | A | 4/1983 |
| WO | 00/57122 | A1 | 9/2000 |

* cited by examiner

*Primary Examiner* — Forrest M Phillips
(74) *Attorney, Agent, or Firm* — Ware, Fressola, Maguire & Barber LLP

(57) ABSTRACT

A firearm suppressor (1) has a suppressor housing (10) defining the outer surface of the suppressor (1), a mounting member (2) for fastening/detaching the suppressor (1) with a barrel (70) of the firearm (7) and having an aperture (20) for a projectile (8) and propellant gases of the firearm (7) to enter the suppressor (1), an interior arranged to form a number of compartments (30), which are separated by conical baffles (3) having an aperture (32) for the projectile to pass through, an exit aperture (60) for the projectile (8) and the propellant gases to exit the suppressor (1), the compartments (30) formed by the conical baffles (3) are different in volume so that in the order of advancing projectile path (PP) the largest compartment (30) is followed by number of smaller compartments (30).

13 Claims, 4 Drawing Sheets

FIREARM SUPPRESSOR

CROSS REFERENCE TO RELATED APPLICATIONS

This application is the U.S. National Stage of International Application Number PCT/FI2012/051124 filed on Nov. 15, 2012, which application is hereby incorporated by reference in its entirety.

TECHNICAL FIELD

The present invention relates to a firearm suppressor comprising a suppressor housing defining the outer surface of the suppressor, a mounting member for fastening/detaching the suppressor with a barrel of the firearm and having an aperture for a projectile and propellant gases of the firearm to enter the suppressor, an interior arranged to form a number of compartments, which are separated by conical baffles having an aperture for the projectile to pass through, an exit aperture for the projectile and the propellant gases to exit the suppressor.

The present invention relates also to the firearm comprising a suppressor.

BACKGROUND OF THE INVENTION

In the field of noise and flash reduction of firearms there has presented quite many different constructions and devices for the same purpose i.e. to dampen the noise and flash caused by the rapid burning of propellants when the firearm is fired. As the benefits of this reduction are quite obvious, the noise of undamped firearm may exceed 130 dB, even 160 dB, and can be harmful for firearm users or anyone nearby and disturb large surrounding areas, for example by a hunting area or by a shooting range. It is also preferred to be avoided or at least minimized in military applications where the sound of the firing immediately attracts the attention of parties concerned. The better the suppressor is in terms of noise reduction and if combined to easy or simple manufacturability, the better the suppressor is in terms of commercial interest.

A firearm bullet or in general a projectile, is rapidly accelerated at firing to an initial velocity of 300 to 1100 m/s depending the type of the firearm. The initial velocity means here the velocity of the projectile when exiting the barrel or corresponding part of a firearm. This means that the initial velocity may be within range on about 0.8 to 3.3 Mach (where 1 Mach is the speed of the sound when the medium is normal atmospheric air in about normal temperature and pressure (ntp)). Thus the flow dynamics range of concern may vary from slightly subsonic to highly supersonic flows.

In case of supersonic noise dampening, the suppressor is not capable of reducing the noise originating from the projectile breaking the sound barrier during the flight to a destination. Thus the aim of the suppressor is to reduce as much as possible the noise generated by the phase when the bullet is no longer in front of that high pressure propellant gas and the pressure is rapidly normalizing to an atmospheric pressure, the burning propellant is exiting the barrel and when the propellant residuals are burning outside the barrel.

From the state of the art various different constructions are known, but the science behind the theory is still in some extent unknown. One publication is EP 2 191 223 B1, which presents one theory and a firearm suppressor applying that theory. The construction shows a suppressor comprising a number of mixer/ejector type nozzles located within the suppressor housing and that the suppressor housing is provided with vent holes for providing ambient air to be mixed with propellant gases at the nozzles.

From the state of the art it is also known EP 0 660 915 B1, which presents a firearm suppressor that can be adapted for use with a wide range of ammunition types by virtue of the following features: an adapter designed to be attached to the mouth of the barrel; an end-piece forming the mouth of the silencer, with an aperture designed to allow the projectile to pass out; a central element, located between the adapter and the end-piece, with a number of compartments disposed one behind the other in a straight line, each compartment having an aperture designed to allow the projectile to pass through; each compartment being attached in modular fashion to the next compartment and the outer walls of the series of compartments forming the outer wall of the silencer.

From the state of the art is WO00/57122, which presents a suppressor having deflector cones for guiding the gas flow. The deflector cones have holes to direct the combustion gases outside the cone.

SUMMARY OF THE INVENTION

The objective of the present invention is to provide a firearm suppressor capable of reducing a significant amount of noise caused by the firing of a firearm. As the flow dynamics of the erupting propellant gases from the firearm is a rather complicated chain of events (phenomenon), one objective of the invention is to have a prolonging effect for the gas flow out from the suppressor housing. This prolonging effect reduces the pressure difference between propellant gases and the atmospheric air, thus causing a smaller shock wave and noise to the atmospheric air. One objective is also to provide a suppressor construction which is capable of producing an effective flow loss, i.e., consume the flow energy inside the suppressor to different losses and thus reducing the noise caused by sudden eruption of propellant gases. One objective is also to enable the residual burning of the propellant gas still containing some unburned propellants within the suppressor housing, thus diminishing the noise effect of suddenly burning residuals outside the barrel.

The present invention is characterized in that the compartments formed by the conical baffles are different in volume so that in the order of advancing projectile path the largest compartment is followed by number of smaller compartments. This enables the high pressure propellant gas to expand first in a sufficiently large compartment and have a long distance for the pressure wave to lose its energy in reflecting, expanding and compressing from the walls of the compartment. The propellant gas has the highest pressure just after the projectile has left the barrel (and entered to the suppressor housing) and that is why the first compartments are designed to be larger than the following compartments, to provide the maximum compartment volume for propellant gas to expand and also for the residuals of propellant to burn out.

According to an embodiment of the invention, the conical baffle diverging to the largest compartment is truncated at the large diameter end so that the outer large diameter of the conical baffle is smaller than the inner diameter of the suppressor housing thus forming an annular opening to a sub volume of the largest compartment in the reversing direction. This feature enables the propellant gas to have a long reflect distance to bounce back and forth. The annular opening chokes the pressure wave entering to the sub volume and thus also reduces the energy of the propellant gas.

According to an embodiment of the invention, the conical baffle (or baffles) has a divergent cone half-angle within a range of 7.5 to 22.5 degrees, preferably 12 to 18 degrees and most preferably 15 degrees. This half-angle means the angle between the projectile path and the surface of the divergent cone. The purpose of this feature is to convert the chemical-thermal energy generated by the burning propellant/created pressure into kinetic energy. The divergent cone of the conical baffle functions as a nozzle which converts the slow moving, high pressure, high temperature gas into high velocity gas of lower pressure and temperature. By selecting the half-angle as recommended, the propellant gas will follow the walls of the divergent cone. Since thrust is the product of mass and velocity, a very high gas velocity behind the projectile is desirable. As the purpose of the suppressor is to eliminate the peak pressure exiting the suppressor, these back and forth energy conversions (pressure→velocity→pressure→velocity . . . ) in adjacent compartments reduces the pressure of exiting propellant gas very effectively. These adjacent compartments at first accelerate the speed of propellant gas, then it is decelerated by the outer cone surface of the following conical baffle and compressed to the following compartments, which are separated from each other by a cylindrical wall structure defining an annular cylindrical sub volume for propellant gases to deaden. After this compression phase the gas follows the projectile to the following compartment and the same accelerating-decelerating chain is happening again, until the number of compartments are gone through.

According to an embodiment of the invention, a following funnel has a largest outer diameter smaller than the inner diameter of the suppressor housing thus forming an annular opening to a sub volume of the largest (normally the first) compartment in the advancing direction. This feature enables the form of the largest compartment to be almost the whole length of the suppressor, thus giving the propellant gas enough space to enlarge and compress back when achieving the back walls of the largest compartment. This cylindrical shape tames the energy of the gas flow very efficiently.

According to an embodiment, also the following compartments are separated from each other by a cylindrical wall structure defining an annular cylindrical sub volume for propellant gases to deaden. To make the construction rigid, but still having suitable spacing between the conical baffles and cylindrical partition walls, at least part of the conical baffles and/or cylindrical wall structures are fitted to a co-axial position in respect to each other by a number of brackets. These brackets are preferably rather small in circumferential direction so that the gas flow may bypass the brackets easily, but being in radial direction rather accurately machined so that the co-axiality of the conical baffles and cylindrical walls can be accurate, thus enabling also the projectile to pass through the suppressor without disturbing side flows which might affect negatively the precision and accuracy of the firearm.

As the pressure of propellant gas is reducing compartment by compartment, according to an embodiment of the invention, the number of compartments, which are separated by conical baffles, is 3 to 6 or even more compartments. This seems to give a relatively good result in sound suppression and also makes the total dimensions of suppressor, in particular for rifle caliber firearms, reasonable small so that the usability of the firearm remains good.

According to an embodiment of the invention, the conical baffles are designed so that an inlet diameter of advancing following conical baffle is less than ⅓ of the diameter of the previous diverging cone at the cross section of the inlet. Thus this gives a certain length/diameter ratio for the conical baffle geometry, of the divergent cone—next outer cone of the following conical baffle. With this diametrical ratio, most of the high speed propellant gas is guided away for a while from the inlet aperture. Suitably the aperture diameter of conical baffle is selected according to the firearm caliber by increasing the projectile diameter by about +10%. Thus the projectile has some clearance to the aperture walls of the conical baffles, it is highly unwanted that the projectile touches a baffle during the flight inside the suppressor—since this destroys the accuracy of the firearm immediately.

According to an embodiment of the invention, the conical baffles consist one aperture for projectile and propulsion gases to advance to the following compartment. From the state of the art suppressor constructions where the baffles are perforated or there are all kind of apertures is known, one for the projectile and some other apertures for only propellant gas. The applicant has noted that with the present construction this kind of extra apertures does not give any positive result to the suppression or accuracy—actually vice versa. Thus the preferred embodiment is a conical baffle consisting of only one aperture for both the projectile and the propellant gases. The suppressor works well also with multiple apertures, but the best result is achieved with only one aperture.

Another aspect of the present invention is characterized in that the exit aperture is formed as a flow nozzle having a trailing edge which is formed to comprise a number of V-shaped notches. This is the final stage for the propellant gas to exit to the atmospheric. As with normal rounded shaped exit aperture, the pressure wave is spreading out in as a ball shaped wave, this feature still shapes the pressure wave so that the sound is diminished even further.

BRIEF DESCRIPTION OF THE DRAWINGS

In the following the invention is disclosed in more detail in reference to the figures, wherein.

DETAILED DESCRIPTION

Figure 1:
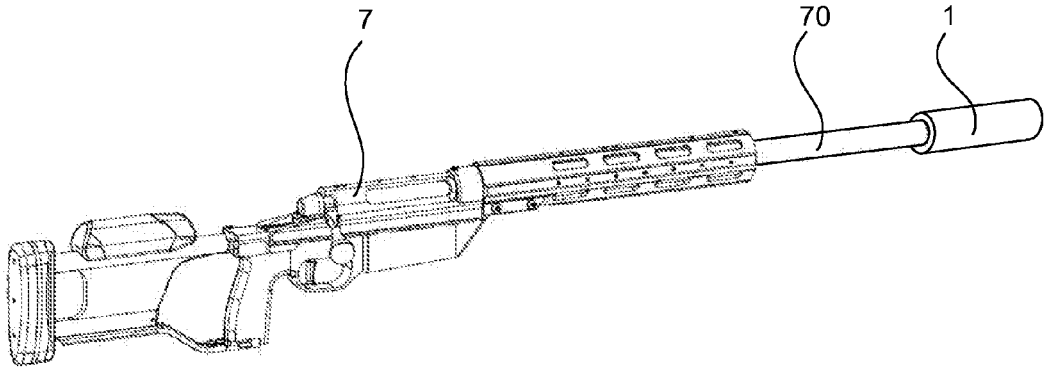
FIG. 1 presents a general overview of a firearm attached with a suppressor

FIG. 1 presents a firearm 7 wherein a suppressor 1 is attached to the barrel 70 of the firearm.

Figure 2:
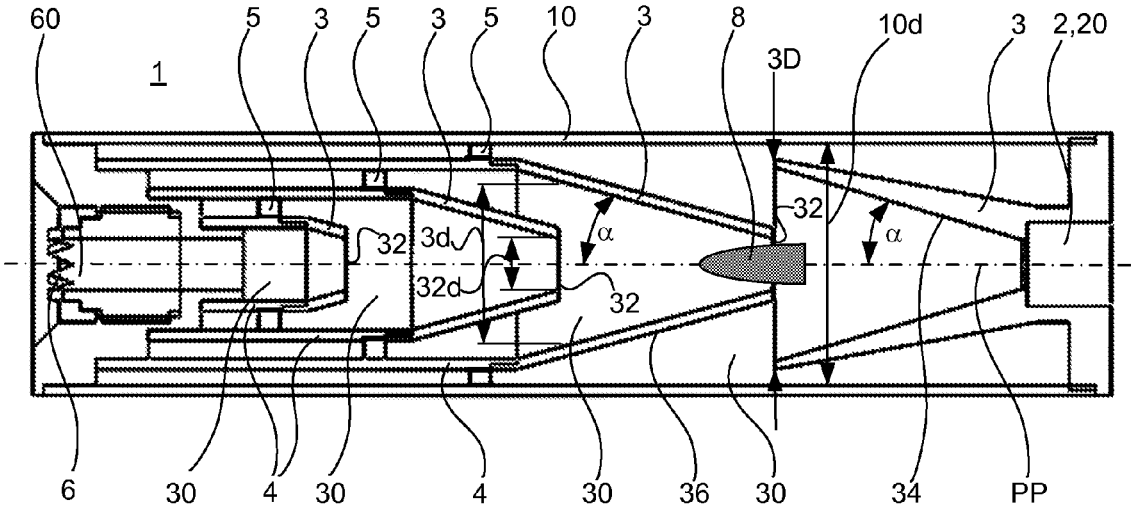
FIG. 2 presents an embodiment of the suppressor shown as lengthwise cross-section along the projectile path PP.

FIG. 2 presents a firearm suppressor 1 comprising a suppressor housing 10 defining the outer surface of the suppressor 1, mounting member 2 having a shape as shown in FIG. 2 for fastening/detaching the suppressor 1 with a barrel 70 of the firearm 7 (not shown in FIG. 2) and having an aperture 20 for a projectile 8 and propellant gases of the firearm 7 to enter the suppressor 1, an interior arranged to form a number of compartments 30, which are separated by conical baffles 3 having an aperture 32 for projectile 8 to pass through, an exit aperture 60 for the projectile 8 and the propellant gases to exit the suppressor 1, where the compartments 30 formed by the conical baffles 3 are different in volume so that in the order of advancing projectile path PP the largest compartment 30 is followed by number of smaller compartments 30. As can be noted from the FIGS. 1 and 2, the suppressor is mainly a rotationally symmetrical cylindrical object with few exceptions to symmetry, such as brackets 5 and exit nozzle 6.

The conical baffle 3 has a divergent cone half-angle α within a range of 7.5 to 22.5 degrees, preferably 12 to 18 degrees and most preferably 15 degrees. With these measures the propellant gas will follow the walls of the divergent cone 34 and thus create quite even flow distribution at the divergent cone 34. An aperture 32 having an inlet diameter 32*d* of advancing following conical baffle 3 is less than ⅓ of the diameter 3*d* of the previous diverging cone 34 at the cross section of the inlet 32. The aperture diameter 32*d* of conical baffle is selected according to the firearm caliber by increasing the projectile diameter by about +10%. It can be increased slightly from this measure, but if it is smaller, the risk of projectile contacting the aperture is increasing.

FIGS. 3*a*, 3*b*, 3*c* and 3*d* presents a schematic idea of compartments 30 formed by the conical baffles 3 and shows that they are different in volume so that in the order of advancing projectile path PP the largest compartment 30 is followed by number of smaller compartments 30. The suppressor is similar to the suppressor of FIG. 2 and the projectile path PP is as shown in FIG. 2, thus the advancing direction of projectile is from right to left.

Figure 3A:
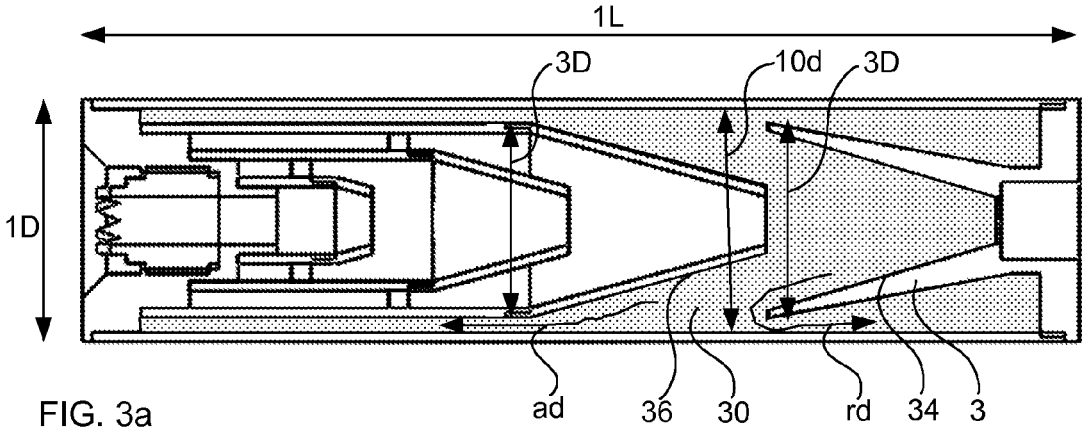
FIG. 3*a*-3*d* presents an embodiment of an arrangement of compartments in the suppressor.

In FIG. 3*a* it is shown the largest compartment 30 visualized as dotted hatching. As can be noted, this largest compartment 30 may be almost the length 1L of the suppressor. The conical baffle 3 diverging to the largest compartment 30 is truncated at the large diameter end so that the outer large diameter 3D of the conical baffle 3 is smaller than the inner diameter 10*d* of the suppressor housing, thus forming an annular opening to a sub volume of the largest compartment 30 in the reversing direction rd. Also the conical baffle 3 having outer cone surface 36 facing the diverging cone 34 of the largest compartment 30, has a largest outer diameter 3D smaller than the inner diameter 10*d* of the suppressor housing thus forming an annular opening to a sub volume of the largest compartment 30 in the advancing direction ad.

Figure 3B:
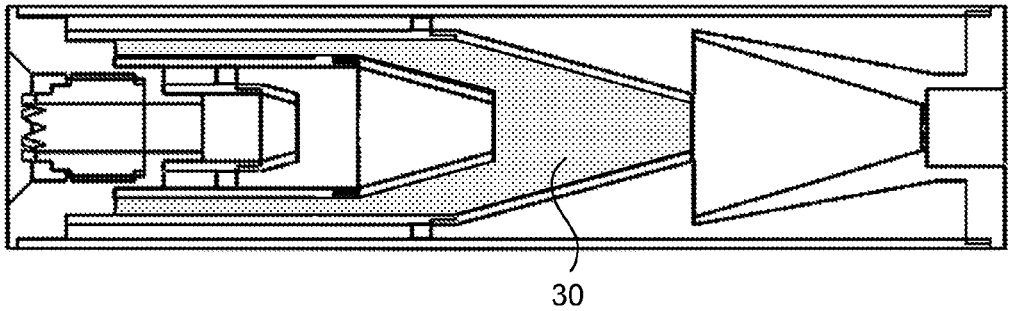

FIG. 3*b* shows in dotted hatching the compartment 30 following the largest compartment 30 shown more in FIG. 3*a*. This compartment shown in hatching and the following compartments 30 are separated from each other by a cylindrical wall 4 structure (see FIG. 2) defining an annular cylindrical sub volume for propellant gases to deaden. In practice the compartments could be named as first, second, third, etc. compartment, but since the largest compartment may be preceded with a small pre-chamber(s) or compartments, this first, second naming is too restrictive.

Figure 3C:
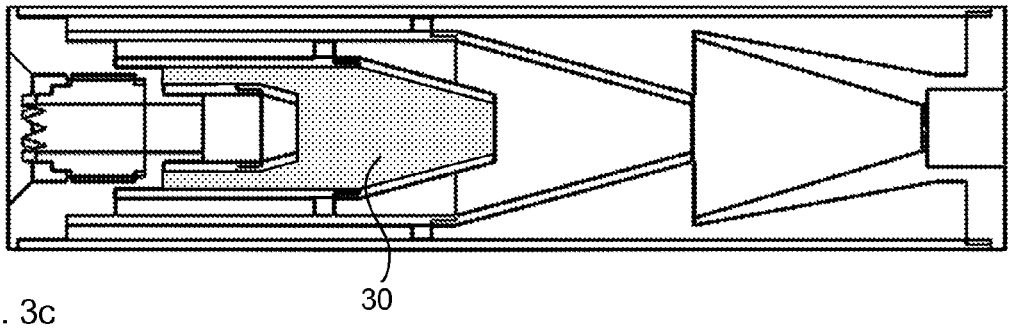
Figure 3D:
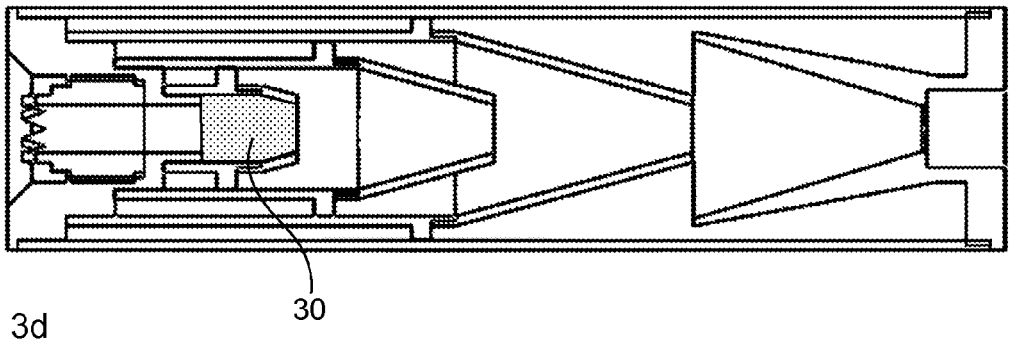

In FIG. 3*c* is shown with dotted hatching the second compartment following the largest compartment. The same design principles may be applied also here, the selected half-angle of the divergent cone, annular cylindrical sub volume to the advancing direction, etc. FIG. 3*d* shows in dotted hatching the last compartment (in this embodiment). However, there may be different the number of compartments 30 separated by conical baffles 3, for example, there may be three to six compartments 30 following each other. The number of compartments depends partly on the available space and wanted maximum outer dimensions of the suppressor. The outer wall or the cylindrical walls and baffles need to have a certain material thickness so that they keep their shape and safety under pressure of use, the pressure following the projectile may exceed 400 MPa, thus the construction must be of rigid nature.

Figure 4:
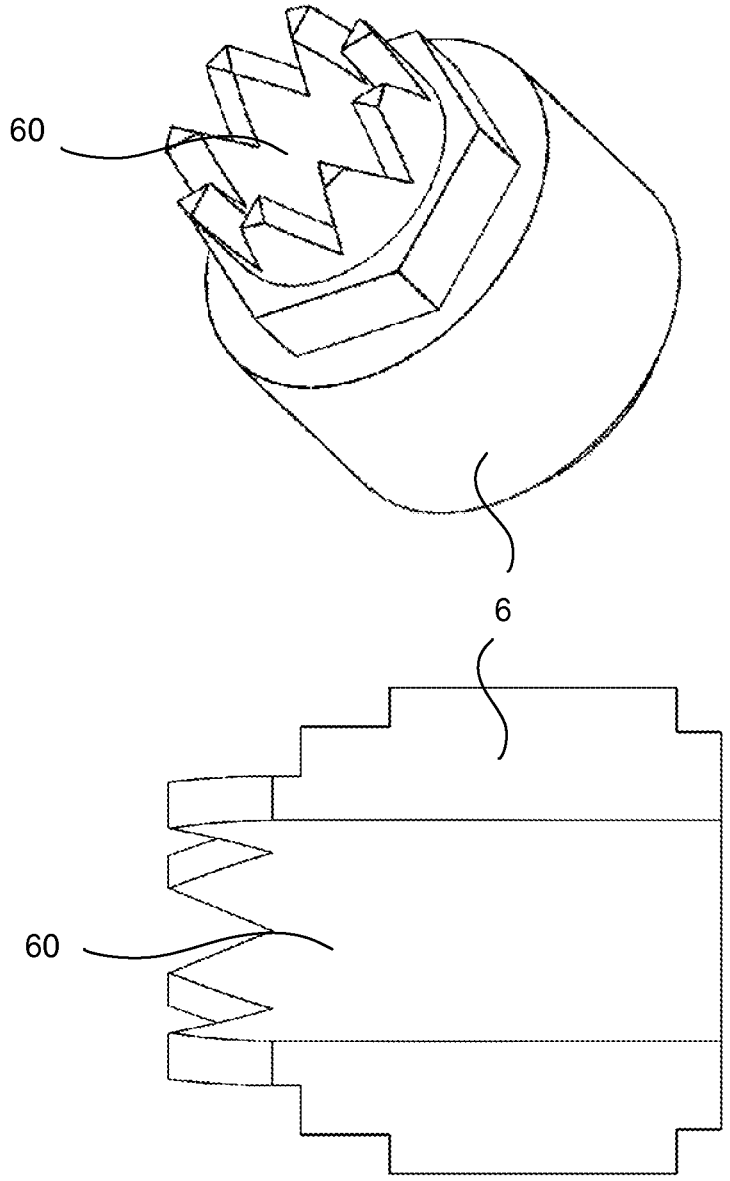
FIG. 4 presents an embodiment of the exit aperture of the suppressor

In FIG. 4 it is shown an embodiment of a flow nozzle 6 forming the exit aperture 60. In the perspective above, the flow nozzle 6 is shown in isometric perspective and in perspective below, it is shown as cross-section along the projectile path. The exit aperture 60 is formed as a flow nozzle 6 having a trailing edge which is formed to comprise a number of V-shaped notches. The flow nozzle V-shape has a V-angle within range of 30 to 60 degrees, preferably 45 degrees. This is the last element shaping the sound created by the pressure of propellant gases.

Figure 5:
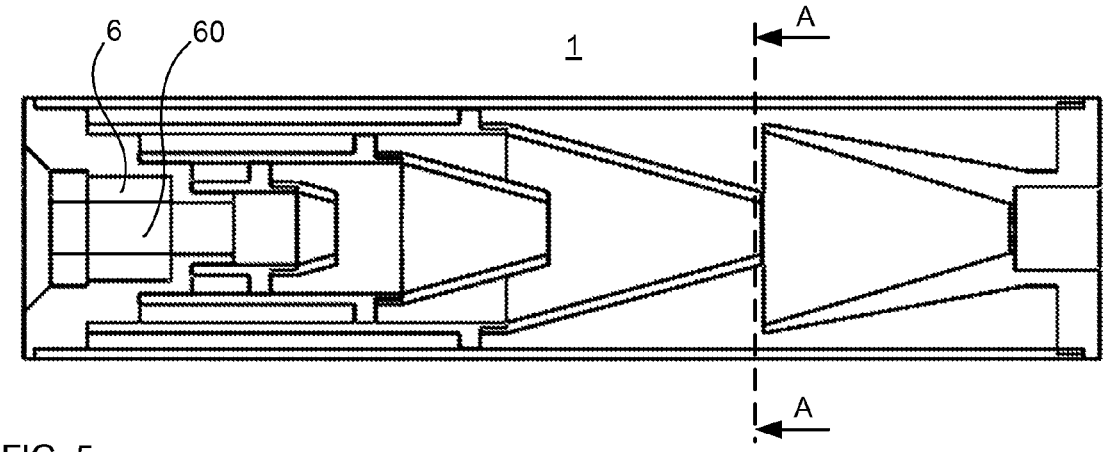
FIG. 5 presents a suppressor with a different kind of exit aperture.

FIG. 5 shows another embodiment of the suppressor of FIG. 2, this version differs by having a different type of exit aperture 60, namely, a plain design of a flow nozzle 6.

Figure 6:
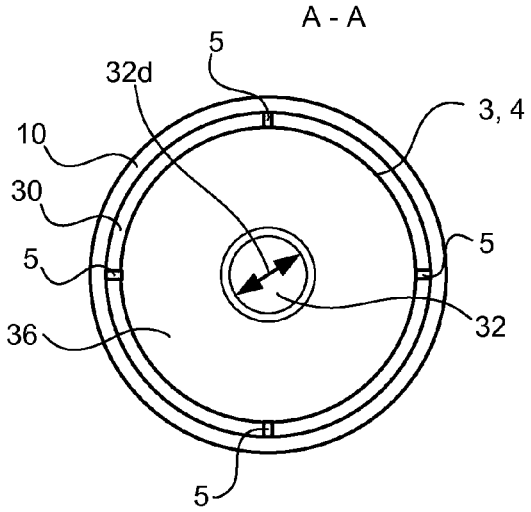
FIG. 6 presents a cross-section of FIG. 5.

In FIG. 6 it is presented a cross section of the suppressor of FIG. 5, along line A-A. The FIG. 6 shows how at least part of the conical baffles 3 and/or cylindrical wall 4 structures are fitted to a co-axial position in respect to each other by a number of brackets 5. These brackets 5 are preferably rather small in circumferential direction as shown, so that the gas flow in compartment 30 may bypass the brackets 5 easily, but being in radial direction rather accurately machined so that the co-axiality of the conical baffles and cylindrical walls can be accurate. Here the brackets 5 evenly maintain the position of baffle 3 or wall 4 in respect to the suppressor housing 10. Thus the outer cone surface 36 and aperture 32, having an aperture diameter 32*d*, stay precisely co-axial in respect to each other.

As evident to those skilled in the art, the invention and its embodiments are not limited to the above-described embodiment examples. Expressions representing the existence of characteristics, such as "the suppressor comprises a housing", are non-restrictive such that the description of characteristics does not exclude or prerequisite the existence of such other characteristics which are not presented in the independent or dependent claims.

REFERENCE NUMBERS IN FIGURES

1 suppressor
1D suppressor outer diameter
1L suppressor length
10 housing
10*d* inner diameter of housing
2 mounting member
20 aperture
3 conical baffle
3D outer large diameter
3*d* inner small diameter
30 compartment
32 aperture of conical baffle
32*d* aperture diameter
34 divergent cone
α half-angle of divergent cone
36 outer cone surface
4 cylindrical wall
5 bracket
6 exit aperture flow nozzle
60 exit aperture
7 firearm
70 firearm barrel
8 projectile
PP projectile path
rd reversing direction
ad advancing direction

The invention claimed is:

1. A firearm suppressor comprising a suppressor housing defining the outer surface of the suppressor, a mounting member for fastening/detaching the suppressor with a barrel of the firearm and having an aperture for a projectile and propellant gases of the firearm to enter the suppressor, an interior arranged to form a number of compartments, which are separated by conical baffles having an aperture for the projectile to pass through, an exit aperture for the projectile and the propellant gases to exit the suppressor, wherein, the compartments formed by the conical baffles are different in volume so that in the order of advancing projectile path the largest compartment is followed by a number of smaller compartments, wherein the following compartments are separated from each other by a cylindrical wall structure defining an annular cylindrical sub volume for propellant gases to deaden, and wherein at least part of the conical baffles and/or cylindrical wall structures are fitted to a co-axial position in respect to each other by a number of brackets.

2. The suppressor of patent claim 1, wherein the conical baffle has a divergent cone half-angle within a range of 7.5 to 22.5 degrees.

3. The suppressor of patent claim 1, wherein the conical baffle diverging to the largest compartment is truncated at the large diameter end so that the outer large diameter of the conical baffle is smaller than the inner diameter of the suppressor housing, thus forming an annular opening to a sub volume of the largest compartment in the reversing direction.

4. The suppressor of patent claim 1, wherein the conical baffle having outer cone surface facing the diverging cone of the largest compartment, has a largest outer diameter smaller than the inner diameter of the suppressor housing thus forming an annular opening to a sub volume of the largest compartment in the advancing direction.

5. The suppressor of claim 2, wherein the range of the divergent cone half-angle is 12 to 18 degrees.

6. The suppressor of patent claim 1, wherein an aperture inlet diameter of advancing following conical baffle is less than ⅓ of the diameter of the previous diverging cone at the cross-section of the inlet.

7. The suppressor of patent claim 1, wherein the number of compartments, which are separated by conical baffles, is three or more compartments.

8. The suppressor of patent claim 1, wherein conical baffle consists of one aperture for projectile and propulsion gases to advance to the following compartment.

9. The suppressor of patent claim 1, wherein the aperture diameter of conical baffle is selected according to the firearm caliber by increasing the projectile diameter by about +10%.

10. The suppressor of patent claim 1, wherein the exit aperture is formed as a flow nozzle having a trailing edge which is formed to comprise a number of V-shaped notches.

11. The suppressor of patent claim 5, wherein the flow nozzle V-shape has a V-angle within range of 30 to 60 degrees, preferably 45 degrees.

12. A firearm comprising the suppressor of claim 1.

13. The suppressor of claim 5, wherein the divergent cone half-angle is 15 degrees.

* * * * *